US009511402B2

(12) United States Patent
Hayashi et al.

(10) Patent No.: US 9,511,402 B2
(45) Date of Patent: Dec. 6, 2016

(54) PRESS DIE AND PRESS MACHINE

(71) Applicants: Koji Hayashi, Tatebayashi (JP); Taichi Shimizu, Midori (JP); Kazumasa Nishio, Ota (JP)

(72) Inventors: Koji Hayashi, Tatebayashi (JP); Taichi Shimizu, Midori (JP); Kazumasa Nishio, Ota (JP)

(73) Assignee: TOA Industries Co., Ltd., Ota-shi (JP)

( * ) Notice: Subject to any disclaimer, the term of this patent is extended or adjusted under 35 U.S.C. 154(b) by 495 days.

(21) Appl. No.: 13/801,184

(22) Filed: Mar. 13, 2013

(65) Prior Publication Data

US 2014/0157854 A1 Jun. 12, 2014

(30) Foreign Application Priority Data

Dec. 7, 2012 (JP) ..... 2012-267776
Dec. 7, 2012 (JP) ..... 2012-267777

(51) Int. Cl.

| | |
|---|---|
| ***B21D 22/02*** | (2006.01) |
| ***B21D 37/16*** | (2006.01) |
| ***B30B 15/06*** | (2006.01) |
| ***B30B 1/26*** | (2006.01) |

(52) U.S. Cl.
CPC ..... *B21D 22/022* (2013.01); *B21D 37/16* (2013.01); *B30B 1/26* (2013.01); *B30B 15/064* (2013.01)

(58) Field of Classification Search
CPC ..... B21D 22/02; B21D 37/04; B21D 37/16; B21D 24/16; B21D 24/00; B21D 22/022; B21D 22/208; B21D 24/005; B21D 26/031; B21D 37/10; B21D 37/05; B21D 37/12; B21D 37/18; B30B 15/064; B30B 15/34; B30B 1/26; B21J 1/06; B21K 29/00; B29C 33/02
USPC ..... 72/381, 394, 354.6, 413
See application file for complete search history.

(56) References Cited

U.S. PATENT DOCUMENTS

| | | | | |
|---|---|---|---|---|
| 6,855,917 | B2 * | 2/2005 | Matsen et al. | 219/659 |
| 6,945,165 | B2 * | 9/2005 | Nagae | 100/280 |
| 8,069,697 | B2 * | 12/2011 | Kurisu et al. | 72/342.3 |
| 2010/0018277 | A1 * | 1/2010 | Hielscher | 72/352 |
| 2011/0209513 | A1 * | 9/2011 | Klintenstedt et al. | 72/60 |

FOREIGN PATENT DOCUMENTS

| | | |
|---|---|---|
| JP | 3-155420 | 7/1991 |
| JP | 2003-94118 | 4/2003 |
| JP | 2006-326620 | 12/2006 |

(Continued)

*Primary Examiner* — Teresa M Ekiert
(74) *Attorney, Agent, or Firm* — Morrison & Foerster LLP

(57) ABSTRACT

The invention enhances a cooling effect on a press die for hot press. A lower die includes a first base, a second base mounted on the first base and having an opening in the center, a support table provided in the opening of the second base, and a die portion detachably mounted on the support table and including die pieces. The die portion is divided in die pieces disposed adjoining each other, and cold water pipes are provided in the die pieces respectively. The cold water pipes are bent in a U shape and inserted in the die pieces respectively, and extended downward from the lower ends of the die pieces respectively. The cold water pipes have cooling water injection ends and cooling water ejection ends in a space between the first base and the support table.

18 Claims, 4 Drawing Sheets

(56) References Cited

FOREIGN PATENT DOCUMENTS

| | | |
|---|---|---|
| JP | 2008-238240 | 10/2008 |
| JP | 2008-284574 | 11/2008 |
| JP | 2010-227978 | 10/2010 |

* cited by examiner

PRESS DIE AND PRESS MACHINE

CROSS-REFERENCE OF THE INVENTION

This application claims priority from Japanese Patent Application Nos. 2012-267776 and 2012-267777, the contents of which are incorporated herein by reference in their entireties.

BACKGROUND OF THE INVENTION

Field of the Invention

The invention relates to a press die and a press machine, particularly, a press die and a press machine for hot press.

Description of the Related Art

For vehicle components, a thinned and high-strength member is used so as to enhance both the safety and economy. For this purpose, so-called hot press is known in which a steel plate heated to high temperature is quenched by cooling the plate with low-temperature press dies. In this method, a steel plate is heated to transformation temperature or higher at which the metal structure of the steel member is transformed into austenite, and the steel plate is formed and rapidly cooled with press dies simultaneously, completing quenching. Conventionally, in order to cool a steel plate rapidly, cooling pipes are provided in press dies. This type of press die is described in Japanese Patent Application Publication No. 2006-326620.

However, only by providing cooling pipes in press dies like in the conventional manner, there occurs a problem in which the press dies are not cooled enough and thus a steel plate is not cooled rapidly enough to obtain a desired strength.

SUMMARY OF THE INVENTION

To solve the described problem, the invention provides a press die including: a base; a die portion detachably mounted on the base and including a plurality of die pieces disposed adjoining each other; and a plurality of cooling pipes provided in the die pieces respectively and extended to an outside of the die pieces, each including a cooling water injection end and a cooling water ejection end.

The invention also provides a press machine including: a slide moving linearly in the vertical direction between a top dead center and a bottom dead center corresponding with rotation of a crank including an eccentric shaft; an upper die mounted on the slide; a lower die mounted so as to be opposed to the upper die; and a controller stopping the rotation of the crank so as to stop the slide that passes the bottom dead center, in which the lower die or the upper die includes a base, a die portion including a plurality of die pieces detachably mounted on the base and disposed adjoining each other, and a plurality of cooling pipes provided in the die pieces respectively and extended to an outside of the die pieces, each including a cooling water injection end and a cooling water ejection end.

DETAILED DESCRIPTION OF THE INVENTION

[Structure of Press Machine]

First, an example of a press machine to which a press die of the invention is applied will be described referring to FIGS. 1A to 3.

Figure 1A:
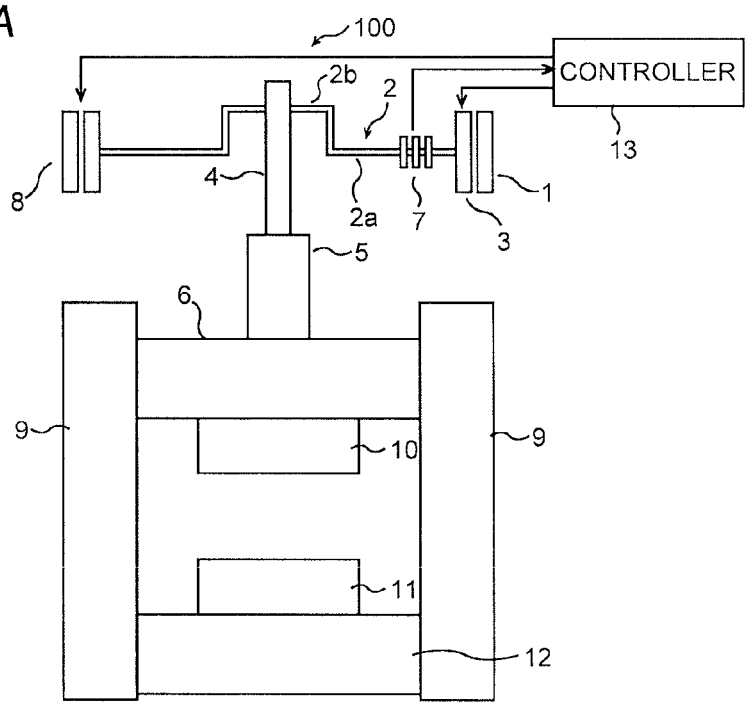
FIGS. 1A and 1B are views showing a press machine.
Figure 1B:
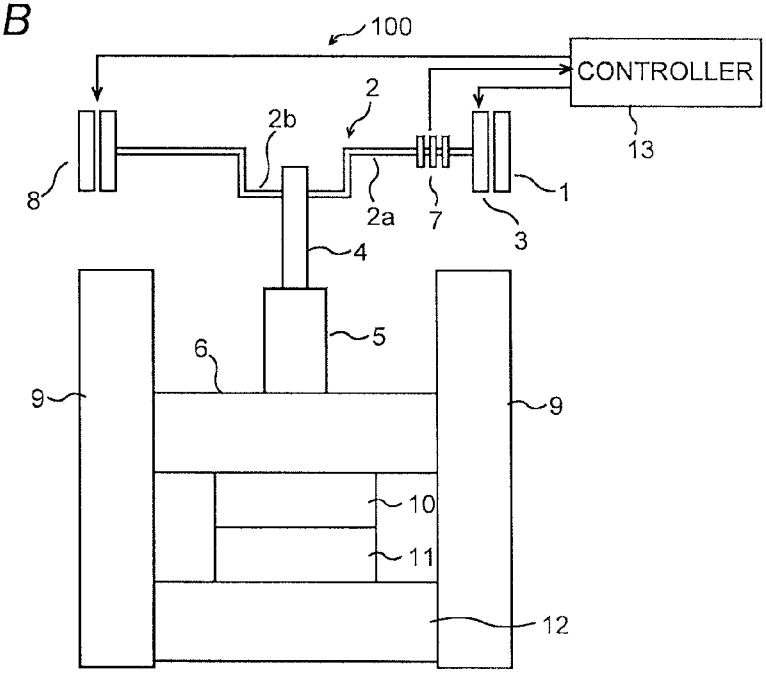

FIGS. 1A and 1B show a structure of a mechanical press machine 100. FIG. 1A shows a state in which a slide 6 and an upper die 10 stop at the top dead center, and FIG. 1B shows a state in which the slide 6 and the upper die 10 stop at the bottom dead center.

This press machine 100 includes a flywheel 1 having rotation energy from a drive motor, a crank 2, a clutch 3 transmitting or cutting the rotation force of the flywheel 1 to the crank 2, and a slide 6 connected to the crank 2 through a connecting rod 4 and moving linearly between the top dead center and the bottom dead center with the rotation of the crank 2. The crank 2 includes a rotation shaft 2*a* and an eccentric shaft 2*b* eccentrically connected to this rotation shaft 2*a*. The connecting rod 4 connects the eccentric shaft 2*b* to the slide 6 through a joint 5. In this case, the connecting rod 4 is rotatably connected to the eccentric shaft 2*b*.

The press machine 100 further includes a rotation angle detection sensor 7 detecting the rotation angle of the rotation shaft 2*a* of the crank 2, a disk brake 8 provided on the end portion of the rotation shaft 2*a* of the crank 2 and stopping the rotation of the rotation shaft 2*a*, a frame 9 provided on both the sides of the slide 6 and guiding the vertical linear motion of the slide 6, an upper die 10 attached to the lower surface of the slide 6, a lower die 11 provided under this upper die 10 so as to be opposed thereto, a bolster 12 supporting the lower die 12 from thereunder, and a controller 13 controlling the operation of the components of the press machine such as the clutch 3, the disk brake 8 and so on.

When the clutch 3 is connected to the rotation shaft 2*a* to transmit the rotation force of the flywheel 1 thereto, the rotation shaft 2*a* and the eccentric shaft 2*b* of the crank 2 rotate and accordingly the slide 6 and the upper die 10 move linearly in the vertical direction.

When the clutch 3 is disconnected from the rotation shaft 2*a* to cut the rotation force of the flywheel 1 and the disk brake 8 works, the slide 6 and the upper die 10 stop. In this case, the rotation angle of the rotation shaft 2*a* of the crank 2 is 0° when the slide 6 lies at the top dead center as shown in FIG. 1A, and the rotation angle of the rotation shaft 2*a* of the crank 2 is 180° when the slide 6 lies at the bottom dead center as shown in FIG. 1B.

Corresponding to an output of the rotation angle detection sensor 7, the controller 13 disconnects the clutch 3 from the rotation shaft 2*a* to cut the rotation force of the flywheel 1 and stops the rotation of the crank 2 with the disk brake 8, and thereby the slide 6 and the upper die 10 stop.

When hot press is performed, a heated steel member (not shown) is carried onto the lower die 11, the upper die 10 moves downward and stops at the bottom dead center for a predetermined time. By this, the steel member is held between the lower die 11 and the upper die 10, and formed and cooled simultaneously by both the dies, thereby completing quenching.

In this case, it is necessary to increase the cooling speed of the steel member by 1) cooling both the dies enough and 2) applying a holding force (pressing force) to the steel member from the lower die 11 and the upper die 10.

Figure 2:
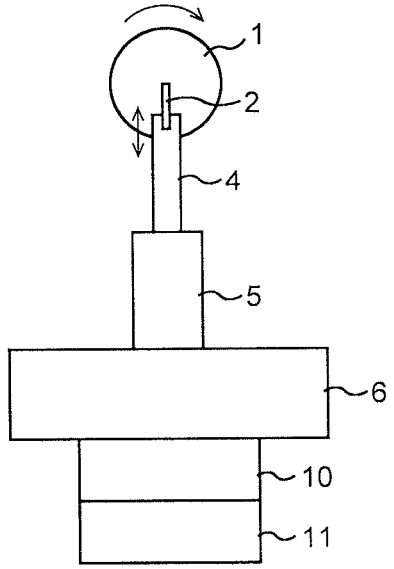
FIG. 2 is a view showing a stop state of the press machine at the bottom dead center.

The application of the holding force (pressing force) to the steel member is achieved by stopping the slide 6 and the upper die 10 at the bottom dead center (the rotation angle of the rotation shaft 2*a*=180°) as shown in FIG. 2.

However, in such a stop state, the eccentric shaft 2*b* and the connecting rod 4 align on the same line. Then, since the rotation force of the rotation shaft 2*a* of the crank 2 is relatively low, the rotation shaft 2*a* of the crank 2 is locked by a repulsive force from the lower die 11 and the rotation shaft 2*a* of the crank 2 can not start rotating again from this locked state.

Figure 3:
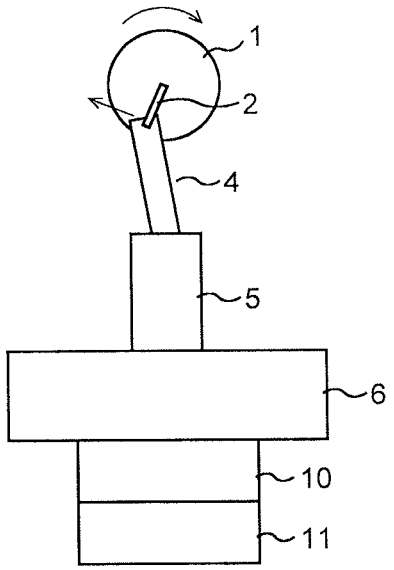
FIG. 3 is a view showing a stop state of the press machine after passing the bottom dead center.

Therefore, as shown in FIG. 3, by stopping the slide 6 and the upper die 10 after the slide 6 passes the bottom dead center (e.g. the rotation angle of the rotation shaft 2*a*=185°), a bit of obtuse angle occurs between the eccentric shaft 2*b* and the connecting rod 4 to prevent the rotation shaft 2*a* of the crank 2 from being locked. In this case, since the repulsive force from the lower die 11 works to enhance the rotation force of the rotation shaft 2*a* of the crank 2 when the rotation shaft 2*a* starts rotating, thereby smoothly starting the rotation shaft 2*a* of the crank 2.

However, when the slide 6 and the upper die 10 stop after the slide 6 passes the bottom dead center, the upper die 10 lies at a slightly upper position from the bottom dead center, and thus there is a problem in which a holding force (pressing force) necessary for hot press is not applied to the steel member.

[Structure of Press Die]

Next, the structure of the press die in the embodiment of the invention will be described referring to FIGS. 4 to 7. In order to attain the objects of 1) cooling both the dies enough and 2) applying a holding force (pressing force) to a steel member from both the dies, the upper die 10 and the lower die 11 of the embodiment of the invention have the following structure.

Since the upper die 10 and the lower die 11 have the same structure, the structure of the lower die 11 will be described hereafter.

The lower die 11 includes a first base 20, a second base 22 having an opening in the center and mounted above the first base 20 spaced therefrom through a support board 21 standing on the peripheral end portion of the first base 20, a support table 23 provided in the opening of the second base 22, and a die portion including five die pieces 11*a* to 11*e* detachably mounted on the support table 23.

In this case, a steel member is mounted on the upper surfaces of the five die pieces 11*a* to 11*e* of the die portion and undergoes a press process. The die portion is divided in the five die pieces 11*a* to 11*e* disposed adjoining each other, and five cold water pipes 24*a* to 24*e* are provided in the die pieces 11*a* to 11*e* respectively. Each of the cold water pipes 24*a* to 24*e* is bent in a U shape and inserted in each of the die pieces 11*a* to 11*e*, and extended downward from each of the lower ends of the die pieces 11*a* to 11*e* through the opening of the second base 22 and the openings of the support table 23. The cold water pipes 24*a* to 24*e* have cooling water injection ends 25*a* to 25*e* and cooling water ejection ends 26*a* to 26*e* in a space between the first base 20 and the support table 23. Cooling water inlets are provided on the cooling water injection ends 25*a* to 25*e* respectively, and cooling water outlets are provided on the cooling water ejection ends 26*a* to 26*e* respectively.

The reason for detachably mounting the die pieces 11*a* to 11*e* on the support table 23 with bolts etc is to enable the exchange of broken or deteriorated die pieces respectively. In the embodiment, the cold water pipes 24*a* to 24*e* are provided in the die pieces 11*a* to 11*e* respectively, and thereby the whole die portion is effectively cooled.

Figure 4:
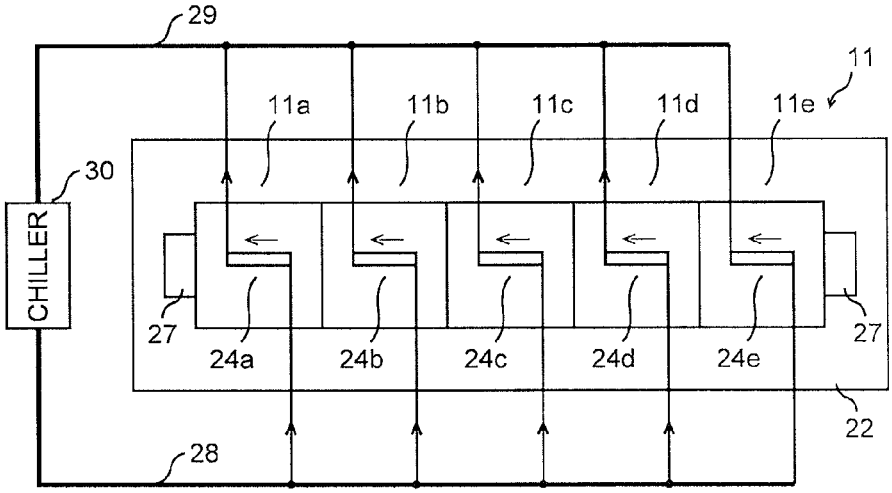
FIG. 4 is a first plan view of a press die in an embodiment of the invention.

The cold water pipes 24*a* to 24*e* have such a connection structure that a cooling water injection pipe 28 is connected to the cooling water injection ends 25*a* to 25*e* oriented in an outside direction from the lower die 11, and a cooling water ejection pipe 29 is connected to the cooling water ejection ends 26*a* to 26*e* oriented in the opposite outside direction as shown in FIG. 4. The cooling water injection pipe 28 and the cooling water ejection pipe 29 are connected to a chiller 30. The chiller 30 is an example of a cooler.

By this, cooling water cooled by the chiller 30 flows through the cooling water injection pipe 28 into the cold water pipes 24*a* to 24*e* dividedly, and is collected by the chiller 30 through the cooling water ejection pipe 29 and cooled again, forming a circulation route of cooling water.

Figure 7:
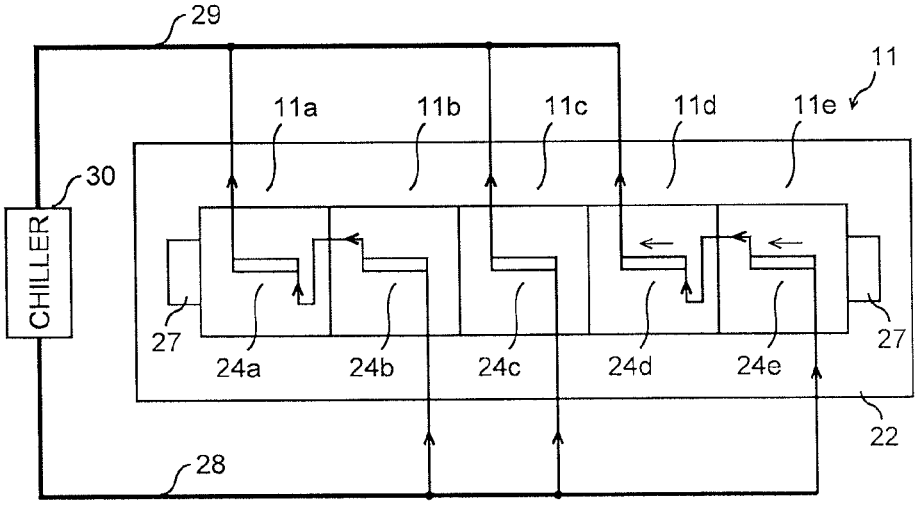
FIG. 7 is a second plan view of the press die in the embodiment of the invention.

Among the die pieces 11*a* to 11*e*, the die piece 11*c* mounted in the center is easiest to heat by a heated steel member mounted thereon. Therefore, as shown in FIG. 7, the cold water pipe 24*c* of the center die piece 11*c* may be connected directly between the cooling water injection pipe 28 and the cooling water ejection pipe 29 so as to enhance the cooling effect. The cold water pipes 24*a* and 24*b* may be connected in series between the cooling water injection pipe 28 and the cooling water ejection pipe 29, and the cold water pipes 24*d* and 24*e* may be also connected in series between the cooling water injection pipe 28 and the cooling water ejection pipe 29. Instead of the circulation route with the chiller 30, such a structure may be formed that the cooling water injection pipe 28 is connected to a water supply such as a water tap and cooling water is ejected from the cooling water ejection pipe 29.

Figure 5:
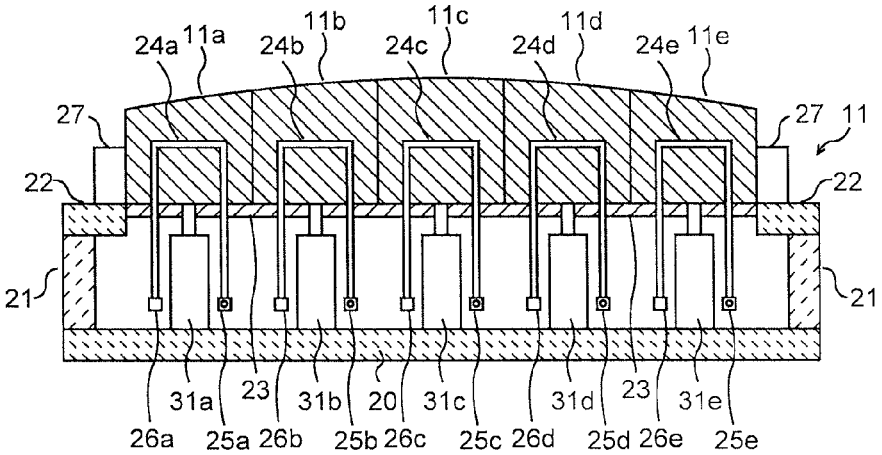
FIG. 5 is a front cross-sectional view of the press die in the embodiment of the invention.
Figure 6:
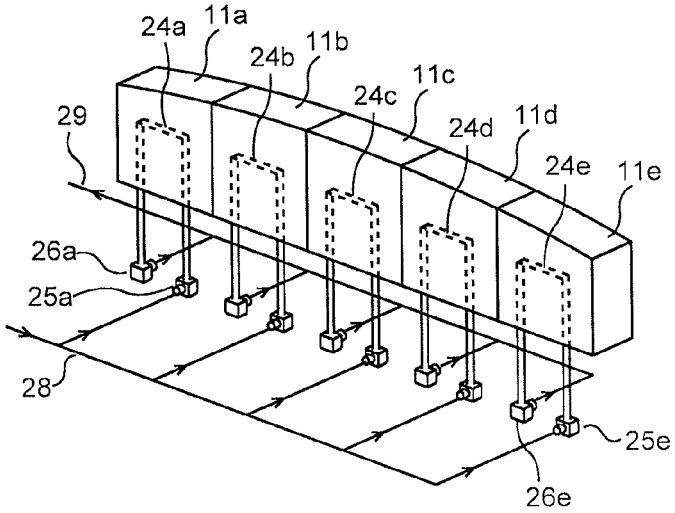
FIG. 6 is a perspective view of a die portion of the press die in the embodiment of the invention.

Furthermore, as shown in FIG. 5, the lower die 11 has spring mechanisms so as to apply a holding force (pressing force) to a steel member. The spring mechanisms are set on the first base 20, corresponding to the die pieces 11*a* to 11*e* respectively, and include springs 31*a* to 31*e* that are elastic in the vertical direction. It is preferable that the springs 31*a* to 31*e* are made by gas springs using gas pressure as a spring force.

The upper ends of the springs 31*a* to 31*e* are connected to the bottom portions of the corresponding die pieces 11*a* to 11*e* through openings formed in the support table 23. The die pieces 11*a* to 11*e* move upward and downward corresponding to the extension and contraction of the springs 31*a* to 31*e*. For guiding the upward and downward motion of the die pieces 11*a* to 11*e* in the vertical direction, guide portions 27 are provided on both the sides of the die portion including the die pieces 11*a* to 11*e*.

A heated steel member is mounted on the die portion of the lower die 11, and then the slide 6 and the upper die 10 move downward. Then, the slide 6 passes the bottom dead center and stops. In this state, the steel member is held between the upper die 11 and the lower die 10. The contraction of the springs 31*a* to 31*e* is maximum at the bottom dead center of the slide 6, but the springs 31*a* to 31*e* still contract on some level even after the slide 6 passes the bottom dead center and the slide 6 and the upper die 10 turn to upward motion. Therefore, the repulsive force (spring force) of these is applied to the steel member W held between the upper die 10 and the lower die 11 as a holding force.

In this case, the repulsive force of the springs 31*a* to 31*e* is maximum at the bottom dead center of the slide 6 (at the rotation angle 180° of the rotation shaft 2*a*), and decreases as the slide 6 moves away from the bottom dead center. Therefore, the bottom dead center passing position of the slide 6 is determined so as to obtain a necessary repulsive force (holding force) for hot press, e.g., the rotation angle of the rotation shaft 2*a*=185°.

As described above, in the embodiment of the invention, the die portion is divided in the die pieces 11*a* to 11*e* and the cold water pipes 24*a* to 24*e* are provided in the die pieces 11*a* to 11*e* respectively, thereby achieving the effective cooling of the whole die portion. Furthermore, by providing the spring mechanisms, the force for holding the steel member is obtained and the rapid cooling effect on the steel member is enhanced.

What is claimed is:

1. A press die comprising:

a base;

a die portion detachably mounted on the base and comprising a plurality of die pieces adjoining each other, each of the die pieces being individually detachable from the base and the rest of the die pieces; and a plurality of cooling pipes provided in corresponding die pieces and extending to an outside of the die pieces, each of the cooling pipes comprising a cooling water injection end and a cooling water ejection end, wherein the die portion includes at least three die pieces.

2. The press die of claim 1, wherein each of the cooling pipes has a U shape.

3. The press die of claim 1, wherein the base comprises a first base and a second base mounted above the first base and having an opening, and the cooling pipes extend from the die pieces to the first base through the opening of the second base.

4. The press die of claim 1, wherein a water inlet at the cooling water injection end and a water outlet at the cooling water ejection end are oriented in opposite directions to each other.

5. The press die of claim 1, further comprising a cooling water injection pipe connected to the cooling water injection ends, a cooling water ejection pipe connected to the cooling water ejection ends, and a cooler connected between the cooling water injection pipe and the cooling water ejection pipe.

6. The press die of claim 1, further comprising a plurality of springs that are elastic in a vertical direction and mounted on the base, wherein the die pieces are mounted on upper surfaces of corresponding springs.

7. The press die of claim 6, further comprising a guide portion disposed on both sides of the die portion so as to guide the die portion in the vertical direction.

8. The press die of claim 6, wherein the spring comprises a gas spring.

9. A press machine comprising:

a slide moving linearly in a vertical direction between a top dead center and a bottom dead center, the top dead center corresponding to a rotational position of crank comprising an eccentric shaft so as to place the slide at the highest vertical position, and the bottom dead center corresponding to a rotational position of the crank so as to place the slide at the lowest vertical position, an upper die mounted on the slide;

a lower die mounted so as to be opposed to the upper die; and a controller stopping the rotation of the crank so as to stop the slide after the slide passes the bottom dead center, wherein the lower die or the upper die comprises a base, a die portion comprising a plurality of die pieces detachably mounted on the base and adjoining each other, each of the die pieces being individually detachable from the base and the rest of the die pieces, and a plurality of cooling pipes provided in corresponding die pieces and extending to an outside of the die pieces, each of the cooling pipes comprising a cooling water injection end and a cooling water ejection end, wherein the die portion includes at least three die pieces.

10. The press machine of claim 9, wherein each of the cooling has a U shape.

11. The press machine of claim 10, wherein the base comprises a first base and a second base mounted above the first base and comprising an opening, and the cooling pipes is extend from the die pieces to the first base through the opening of the second base.

12. The press machine of claim 9, wherein a water inlet at the cooling water injection end and a water outlet at the cooling water ejection end are oriented in opposite directions to each other.

13. The press machine of claim 12, further comprising a cooling water injection pipe connected to the cooling water injection ends, a cooling water ejection pipe connected to the cooling water ejection ends, and a cooler connected between the cooling water injection pipe and the cooling water ejection pipe.

14. The press machine of claim 9, further comprising a plurality of springs that are elastic in the vertical direction and mounted on the base, where in the die pieces are mounted on upper surfaces of corresponding springs.

15. The press machine of claim 9, further comprising a guide portion disposed on both sides of the die portion so as to guide the die portion in the vertical direction.

16. The press machine of claim 14, wherein the spring comprises a gas spring.

17. The press die of claim 1, wherein each of the die pieces includes only one continuous cooling pipe.

18. The press machine of claim 9, wherein each of the die pieces includes only one continuous cooling pipe.

* * * * *